United States Patent [19]

Apothéloz

[11] Patent Number: 4,567,830

[45] Date of Patent: Feb. 4, 1986

[54] IMPACT FUZE

[75] Inventor: Robert Apothéloz, Greifensee, Switzerland

[73] Assignee: Werkzeugmaschinenfabrik Oerlikon-Bührle AG, Zürich, Switzerland

[21] Appl. No.: 575,468

[22] Filed: Jan. 30, 1984

[30] Foreign Application Priority Data

Feb. 15, 1983 [CH] Switzerland ..... 822/83

[51] Int. Cl.[4] ..... F42C 15/26

[52] U.S. Cl. ..... 102/271; 102/262; 102/266

[58] Field of Search ..... 102/262, 265, 266, 272, 102/233, 216, 270, 271, 236

[56] References Cited

U.S. PATENT DOCUMENTS

| | | | |
|---|---|---|---|
| 2,483,555 | 10/1949 | Nichols | 102/271 X |
| 2,664,822 | 1/1954 | Hale | 102/271 X |
| 3,380,384 | 4/1968 | Kaiser et al. | 102/266 |
| 3,422,764 | 1/1969 | Kaiser | 102/233 |
| 3,732,825 | 5/1973 | Apotheloz | 102/236 |
| 4,230,042 | 10/1980 | Popovitch | 102/233 |

FOREIGN PATENT DOCUMENTS

| | | |
|---|---|---|
| 525053 | 4/1931 | Fed. Rep. of Germany . |
| 1138663 | 10/1962 | Fed. Rep. of Germany . |
| 2015284 | 11/1970 | Fed. Rep. of Germany . |
| 502724 | 2/1920 | France . |

*Primary Examiner*—David H. Brown
*Attorney, Agent, or Firm*—Werner W. Kleeman

[57] ABSTRACT

The impact fuze is as light as possible and protects a time-delay device against preliminary destruction at impact of the projectile in or at the target in order that the projectile can penetrate as deeply as possible into or through a hard target, for instance a concrete wall, before the projectile is detonated. A steel housing is introduced into the interior of a light metal housing of the impact fuze in order to fulfill both of these requirements.

5 Claims, 1 Drawing Figure

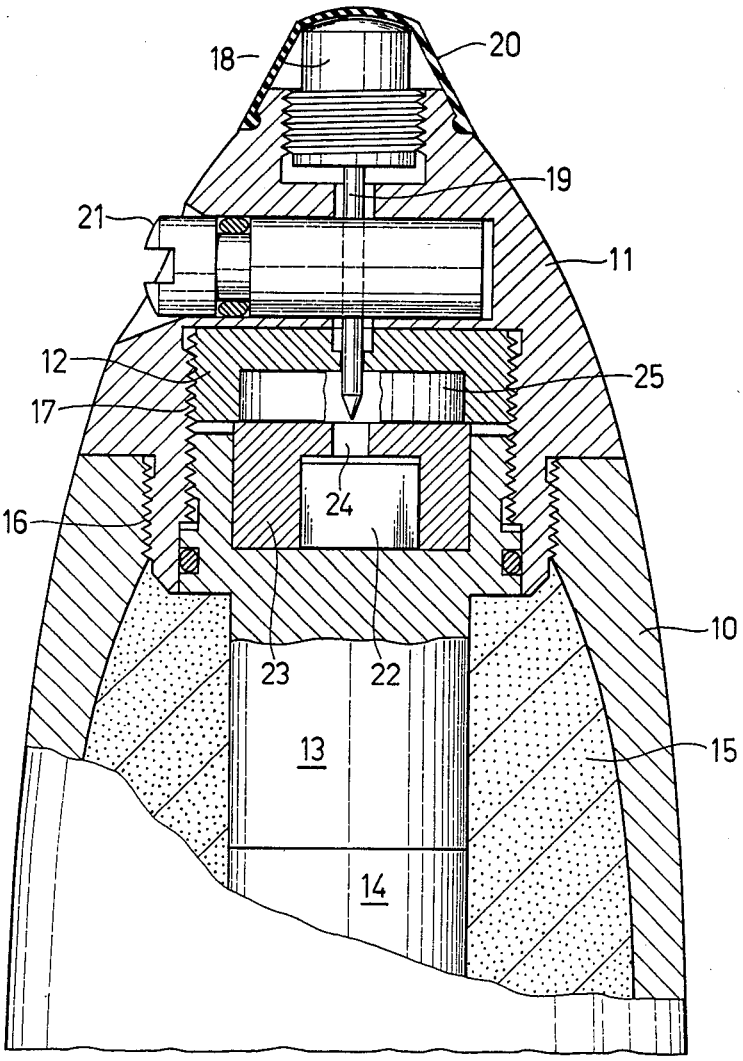
18
20
19
21
11
12
25
17
24
16
10
23
22
13
15
14

IMPACT FUZE

BACKGROUND OF THE INVENTION

The present invention broadly relates to a fuze device and, more specifically, pertains to a new and improved construction of an impact fuze for a projectile with an impact fuze housing which forms the point or tip of the projectile. This impact fuze housing is mounted in the projectile by threaded means and contains all and especially all principal fuze components of the projectile.

It is common practice to use either a heavy steel housing or a light metal housing for such impact fuzes. Steel housings have the advantage that a fuze device can penetrate more deeply into the target before it is destroyed. Light metal housings have the advantage of reducing the weight of the fuze device.

A point-detonating impact fuze of this type is known from U.S. Pat. No. 4,230,042, granted to Dragolyoub Popovitch on Oct. 28, 1980 which comprises two fuze housings, the foremost or forward one of which is formed of a lightweight material, for instance plastic, and the other is formed of steel. This known impact fuze is therefore relatively heavy and does not fulfill the demand for a relatively light fuze.

A so-called switchable fuze can be switched from instantaneous detonation to time-delayed detonation. A fuze pin which is actuated by the impact of the projectile in the target is provided for instantaneous detonation. The instantaneous detonation takes place before the projectile has penetrated deeply into the target. For time-delayed detonation, a device is provided which initiates detonation only after impact of the projectile in the target. Such a time-delay device is disclosed, for instance, in the commonly assigned, copending U.S. patent application Ser. No. 340,488, filed Jan. 18, 1982, now U.S. Pat. No. 4,455,939, granted on June 26, 1984. The delayed detonation takes place only after the projectile has penetrated relatively deeply into the target. If the projectile is to penetrate into a concrete wall, there is a risk that the time-delay device, which is a principal fuze component, will be destroyed or that the detonation will take place too soon.

SUMMARY OF THE INVENTION

Therefore, with the foregoing in mind it is a primary object of the present invention to provide a new and improved construction of an impact fuze device which does not have associated with it the aforementioned drawbacks and shortcomings of the prior art constructions.

Another and more specific object of the present invention aims at providing a new and improved construction of an impact fuze device of the previously mentioned type which is light in weight and capable of penetrating as deeply as possible into a hard target, for instance a concrete wall, and will still detonate reliably, so that, for instance, premature destruction of the time-delay fuze device due to deformation at impact in the target is prevented.

Yet a further significant object of the present invention aims at providing a new and improved construction of a point-detonating impact fuze device of the character described which is relatively simple in construction and design, extremely economical to manufacture, highly reliable in operation, not readily subject to breakdown or malfunction and requires a minimum of maintenance and servicing.

Now in order to implement these and still further objects of the invention, which will become more readily apparent as the description proceeds, the impact fuze device of the present invention is manifested by the features that a steel housing is introduced into the interior of a lightweight or light metal housing defining the impact fuze housing. The steel housing is preferably screwed or threaded into the light metal housing.

BRIEF DESCRIPTION OF THE DRAWING

The invention will be better understood and objects other than those set forth above, will become apparent when consideration is given to the following detailed description thereof. Such description makes reference to the annexed drawing wherein the single FIGURE is a schematic longitudinal section through an impact fuze constructed according to the present invention.

DETAILED DESCRIPTION OF THE PREFERRED EMBODIMENTS

Describing now the single FIGURE of the drawing, it is to be understood that to simplify the showing of the drawing only enough of the structure of the impact fuze device or impact fuze has been illustrated therein as is needed to enable one skilled in the art to readily understand the underlying principles and concepts of this invention. The illustrated exemplary embodiment of impact fuze device will be seen to comprise a lightweight of light metal housing 11, for instance formed of plastic or aluminum or a suitable aluminum alloy and defining the impact fuze housing, which is screwed or threaded into a projectile body or projectile 10 and forms the tip or head of such projectile. A high strength housing, such as a steel housing 12 and a fuze housing member 13 are screwed into this light metal housing 11. The fuze housing member 13 contains a reinforcing or reinforcement charge 14 and extends into an explosive charge 15 in the interior of the projectile body 10. A first thread 16 interconnects the projectile body 10 and the light metal housing 11. A second thread 17 connects the fuze housing member 13 with the light metal housing 11. The same thread 17 also serves to fix the steel housing 12 in the light metal housing 11. An activating button 18 or equivalent structure is disposed in the pointed head or tip of the light metal housing 11 to drive or displace a detonating or firing pin 19. To prevent the entry of moisture into the impact fuze, the activating button 18 is advantageously covered by an elastic cap 20. A conventional device 21 as known, for example, from U.S. Pat. No. 3,732,825, granted May 15, 1973, switches the impact fuze from instantaneous detonation to time-delayed detonation and, in the time-delayed detonation position, prevents the detonating or firing pin 19 from being driven by the movement of the activating button 18. The time-delayed detonation is accomplished by any suitable time-delay device 25.

The detonating or firing pin 19 strikes and penetrates a not particularly here depicted but conventional fuze capsule disposed in an insert or slide 22. The insert or slide 22 is moveably held in a carrier or support 23. This carrier or support 23 is appropriately fixed to the fuze housing member 13 and is provided with a bore 24. The detonating or firing pin 19 can strike the fuze capsule through the bore 24 as soon as the insert or slide 22 has been moved out of a safety position into an armed position as known, for example, from U.S. Pat. No.

3,732,825, granted May 15, 1973. The steel housing 12 protects the pyrotechnical components as well as the time-delay device 25 against premature destruction at impact. This time-delay device 25 is located internally of the steel housing 12. By means of such time-delay device 25 the reinforcing charge 14 is ignited after an adjustable time after impact after the switching device 21 has been set to operate in its mode, as known, for example, from U.S. Pat. No. 3,732,825, granted May 15, 1973. The firing pin 19, the insert or slide 22 and the time-delay device 25 constitute principal fuze components which are protected by the steel housing 12.

The impact fuze according to the invention functions in the following manner:

If the switching device 21 is in the instantaneous detonation position, the activating button 18 is pressed by the impact of the projectile on the target and drives the detonating or firing pin 19 against the fuze capsule located in the insert or slide 22, which has appropriately moved into the armed position during the flight of the projectile. The projectile is therefore substantially instantaneously detonated before it penetrates the target i.e. before the time-delay device 25 times out.

If, however, the switching device 21 is in the time-delayed position, the activating button 18 will still be pressed by the impact of the projectile in the target, but will not be able to drive the detonating or firing pin 19 against the fuze capsule in the insert or slide 22. The projectile will then be delay-detonated by the time-delay device 25, i.e. after the impact of the projectile in the target. During this time the projectile can penetrate relatively deeply into the target, for instance into a concrete wall. During penetration into the target the pyrotechnical components and the time-delay device must be adequately protected from deformation to prevent them from malfunctioning. Such deformations are advantageously prevented by the steel housing 12 introduced into the light metal housing 11.

While there are shown and described present preferred embodiments of the invention, it is to be distinctly understood that the invention is not limited thereto, but may be otherwise variously embodied and practiced within the scope of the following claims.

Accordingly, I claim:

1. An impact fuze for a projectile comprising:

a projectile body;

an impact fuze housing having a substantially pointed tip and threadably mounted in said projectile body;

said impact fuze housing accommodating at least a time-delay device of said impact fuze;

a protective inner housing threadably mounted in its entirety in the interior of said impact fuze housing and lining part of the interior of said impact fuze housing;

said impact fuze housing being formed of light metal; and said protective inner housing being formed of steel and protecting at least said time-delay device.

2. An impact fuze for a projectile comprising:

a projectile body;

an impact fuze housing having a substantially pointed tip portion;

means for connecting said impact fuze housing with said projectile body;

a time-delay constituting a fuze component of the impact fuze;

said impact fuze housing accommodating at least said time-delay device;

a protective inner housing threadably mounted in its entirety in the interior of said impact fuze housing and lining part of the interior of said impact fuze housing;

said impact fuze housing being formed of a lightweight material; and said protective inner housing being formed of a high strength material and protecting at least said time-delay device.

3. An impact fuze for a projectile, comprising:

a projectile body;

an impact fuze housing having a substantially pointed tip;

said substantially pointed tip being mounted to said projectile body by a threaded connection;

a time-delay device constituting a fuze component of the projectile;

said impact fuze housing having an interior;

said interior comprising a void accommodating at least said time-delay device;

said void of said interior being bounded by at least one inner wall;

a protective inner housing lining at least a part of said at least one inner wall;

said impact fuze housing being made of a lightweight material;

said protective inner housing being made of a high strength material;

said protective inner housing being mounted within said impact fuze housing by a threaded connection; and said protective inner housing protecting at least said time-delay device.

4. The impact fuze as defined in claim 3, wherein: said impact fuze housing defines a single housing.

5. The impact fuze as defined in claim 3, wherein: said protective inner housing is accommodated in its entirety within said impact fuze housing.

* * * * *

UNITED STATES PATENT AND TRADEMARK OFFICE

CERTIFICATE OF CORRECTION

PATENT NO. : 4,567,830

DATED : February 4, 1986

INVENTOR(S) : ROBERT APOTHELOZ

It is certified that error appears in the above—identified patent and that said Letters Patent is hereby corrected as shown below:

Column 2, line 51, after "conventional" please insert --switching--

Column 4, line 13, claim 2, after "time-delay" please insert --device--

Signed and Sealed this

Twenty-ninth Day of April 1986

[SEAL]

Attest:

DONALD J. QUIGG

Attesting Officer

Commissioner of Patents and Trademarks